US009096401B2

(12) United States Patent
Ueyama et al.

(10) Patent No.: US 9,096,401 B2
(45) Date of Patent: Aug. 4, 2015

(54) RECORDING APPARATUS

(71) Applicant: SEIKO EPSON CORPORATION, Tokyo (JP)

(72) Inventors: Naohiro Ueyama, Matsumoto (JP); Hideo Mikuriya, Suwa (JP); Masahiro Ogihara, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 13/848,447

(22) Filed: Mar. 21, 2013

(65) Prior Publication Data

US 2013/0306784 A1 Nov. 21, 2013

(30) Foreign Application Priority Data

May 18, 2012 (JP) ..... 2012-114156

(51) Int. Cl.

| | |
|---|---|
| ***B41J 15/00*** | (2006.01) |
| ***B65H 19/10*** | (2006.01) |
| ***B41J 11/00*** | (2006.01) |
| ***B41J 15/04*** | (2006.01) |

(52) U.S. Cl.

CPC ..... *B65H 19/10* (2013.01); *B41J 11/001* (2013.01); *B41J 15/042* (2013.01)

(58) Field of Classification Search

USPC ..... 242/558, 560, 560.1; 400/609, 613

See application file for complete search history.

(56) References Cited

U.S. PATENT DOCUMENTS

| | | | | |
|---|---|---|---|---|
| 5,023,728 | A | 6/1991 | Nimura et al. | |
| 5,036,359 | A | 7/1991 | Duijve et al. | |
| 5,230,576 | A * | 7/1993 | Sone | 400/649 |
| 5,553,808 | A | 9/1996 | Vassos et al. | |
| 2001/0046405 | A1* | 11/2001 | Miyazaki | 400/605 |
| 2002/0130941 | A1 | 9/2002 | Tanaami | |
| 2005/0146587 | A1 | 7/2005 | Asakura | |
| 2011/0192930 | A1* | 8/2011 | Horikawa | 242/560 |
| 2011/0316951 | A1* | 12/2011 | Horikawa | 347/104 |

FOREIGN PATENT DOCUMENTS

| | | |
|---|---|---|
| JP | 01-114471 | 5/1989 |
| JP | 02-225245 | 9/1990 |
| JP | 03-097440 | 10/1991 |
| JP | 08-501265 | 2/1996 |
| JP | 10-007294 | 1/1998 |
| JP | 11-331563 | 11/1999 |
| JP | 2000-071534 | 3/2000 |
| JP | 2002-348011 | 12/2002 |
| JP | 2004-001247 | 1/2004 |
| JP | 2004-181823 | 7/2004 |
| JP | 2005-194053 | 7/2005 |
| JP | 2006-056655 | 3/2006 |
| JP | 2006-240846 | 9/2006 |

(Continued)

*Primary Examiner* — Sang Kim

(74) *Attorney, Agent, or Firm* — Workman Nydegger

(57) ABSTRACT

A recording apparatus includes a plurality of roll-type medium loading unit that are positioned so that a roll-type medium can be loaded therein from a front of the recording apparatus; a transportation unit that transports the medium which has been fed from the roll-type medium loading unit in the downstream direction; and a recording unit that performs recording on the transported medium, wherein the roll-type medium loading unit includes a first roll-type medium loading unit that is disposed at a position above the recording unit and a second roll-type medium loading unit that is disposed at a position below the recording unit.

7 Claims, 7 Drawing Sheets

(56) References Cited

FOREIGN PATENT DOCUMENTS

| | | |
|---|---|---|
| JP | 2007-145459 | 6/2007 |
| JP | 2007-161382 | 6/2007 |
| JP | 2009-226696 | 10/2009 |
| JP | 2010-215367 | 9/2010 |
| JP | 2011-046519 | 3/2011 |

* cited by examiner

RECORDING APPARATUS

BACKGROUND

1. Technical Field

The present invention relates to a recording apparatus that includes a plurality of roll-type medium loading units in which a roll-type medium as a recording target of a recording unit is loaded.

2. Related Art

For example, JP-A-2002-348011 (e.g., see paragraph [0064], FIG. 1) and JP-A-2000-71534 (e.g., see paragraphs [0015], [0017], [0018], FIG. 1, FIG. 2) discloses a recording apparatus that includes a plurality of roll-type medium loading units in which roll-type medium (such as a roll of paper) can be loaded. In JP-A-2002-348011, a plurality of roll-type medium loading units (an upper roll holder and a lower roll holder) are disposed at positions below the recording unit (lower position of the apparatus body) and configured to be capable of drawing forward (on the side of an ejection unit) from the apparatus body (front access).

In JP-A-2000-71534, a sheet feeding unit, a recording unit (printing unit) and an ejected paper stacker are positioned at the upper, middle and lower positions, respectively. In the sheet feeding unit that is positioned above the recording unit, a plurality of roll medium loading units (spindle receiving members) are positioned such that the roll-type medium can be replaced from the front of the apparatus body.

However, JP-A-2002-348011 has a problem of low accessibility particularly to the upper roll-type medium, since the plurality of roll-type medium loading units are positioned below the recording unit. For example, during continuous recording of the plurality of roll-type medium, when the medium from the upper roll-type medium runs out, the medium is then supplied from the lower roll-type medium to the recording unit. However, the medium passes through the path at the front of the upper roll-type medium loading unit and interferes with replacement of the upper roll-type medium. As a result, before supplying the medium from the lower roll-type medium to the recording unit, it is necessary to take a step of replacing the upper roll-type medium which has run out of the medium with a new medium.

Further, JP-A-2000-71534 has a problem of low loading ability particularly to the lower roll-type medium, since the plurality of roll-type medium loading units are positioned above the recording unit. For example, during continuous recording of the plurality of roll-type medium, when the medium from the lower roll-type medium runs out, the medium is then supplied from the upper roll-type medium to the recording unit. However, the medium passes through the path at the front of the lower roll-type medium loading unit and interferes with replacement of the lower roll-type medium. As a result, before supplying the medium from the upper roll-type medium to the recording unit, it is necessary to take a step of replacing the lower roll-type medium has run out of the medium with a new medium.

Accordingly, in the above configuration that the plurality of roll-type medium loading units are positioned on the same side with respect to the recording unit, there is a problem in that one of the roll-type mediums loaded in the plurality of roll-type medium loading units interferes with loading of the other of the roll-type mediums.

SUMMARY

An advantage of some aspects of the invention is a recording apparatus that is capable of accessing a plurality of roll-type medium loading units with ease during operations such as loading of the roll-type medium into the roll-type medium loading unit is provided.

According to an aspect of the invention, a recording apparatus includes a plurality of roll-type medium loading unit that are positioned so that a roll-type medium can be loaded therein from a front of the recording apparatus; a transportation unit that transports the medium which has been fed from the roll-type medium loading unit in the downstream direction; and a recording unit that performs recording on the transported medium, wherein the roll-type medium loading unit includes a first roll-type medium loading unit that is disposed at a position above the recording unit and a second roll-type medium loading unit that is disposed at a position below the recording unit.

With this configuration, the plurality of roll-type medium loading units are separately provided at the upper and lower positions with respect to the recording unit, respectively, and are configured such that the roll-type medium can be loaded from the front of the recording apparatus. Accordingly, the plurality of roll-type medium loading units can be easily accessed in the loading operation of the roll-type medium into the plurality of roll-type medium loading units.

According to an aspect of the invention, it is preferable that the recording apparatus includes a guide member that is disposed at the front of the second roll-type medium loading unit which is positioned at a waiting position where recording can be performed by the recording unit so that the guide member guides the recorded medium when the medium is ejected, wherein the guide member is configured to be movable between a guiding position where the guide member guides the medium and a retracted position where the guide member is positioned so as not to interfere with the second roll-type medium loading unit during loading of the roll-type medium into the second roll-type medium loading unit.

With this configuration, during an access such as the loading operation into the second roll-type medium loading unit which is positioned at the waiting position, the guide member disposed at the front of the second roll-type medium loading unit are moved from the guiding position to the retracted position, thereby preventing the guide member from interfering with the loading operation into the second roll-type medium loading unit and enabling the second roll-type medium loading unit to be accessed with ease.

According to an aspect of the invention, in the recording apparatus, it is preferable that the second roll-type medium loading unit is configured to be movable between a waiting position where recording can be performed by the recording unit and a loading position which is a position forward of the waiting position during loading of the roll-type medium.

With this configuration, since the second roll-type medium loading unit can be drawn forward from the waiting position to the loading position, the loading operation can be relatively easily performed. Further, since the second roll-type medium loading unit can be moved from the loading position after the loading operation, the second roll-type medium can be easily positioned at the waiting position. Accordingly, the second roll-type medium loading unit can be accessed with ease in the loading operation.

According to an aspect of the invention, in the recording apparatus, it is preferable that the second roll-type medium loading unit includes an abutment section that abuts against guide member when the second roll-type medium loading unit moves from the waiting position to the loading position, and the guide member moves from the guiding position to the retracted position with the abutment of the abutment section.

With this configuration, When the second roll-type medium loading unit moves from the waiting position to the loading position, the abutment section abuts against the guide member and the guide member moves from the guiding position to the retracted position. Accordingly, there is no need to perform an additional operation such as moving the guide member from the guiding position to the retracted position in advance. Therefore, the second roll-type medium loading unit can be relatively easily positioned from the waiting position to the loading position.

According to an aspect of the invention, it is preferable that the recording apparatus includes a first moving mechanism that moves the second roil-type medium loading unit between the waiting position and the loading position, and a second moving mechanism that displaces the loading position of the second roll-type medium loading unit that has been positioned by the first moving mechanism further forward.

With this configuration, the loading position of the second roll-type medium loading unit that has been positioned by the first moving mechanism can be moved further forward by the second moving mechanism. Accordingly, the loading operation of the roll-type medium into the second roll-type medium loading unit can be easily performed.

According to an aspect of the invention, it is preferable that the recording apparatus includes at least one medium guide section that guide the roll-type medium loaded in the second roll-type medium loading unit to the recording unit, wherein at least one of the medium guide sections is configured to move with the second roll-type medium loading unit.

With this configuration, when the second roll-type medium loading unit moves from the waiting position to the loading position, at least one of the medium guide sections move with the second roll-type medium loading unit. Accordingly, after the roll-type medium is loaded into the second roll-type medium loading unit, the medium pulled out from the roll-type medium can be relatively easily set on the medium guide sections from the front of the recording apparatus.

According to an aspect of the invention, in the recording apparatus, it is preferable that the guide member includes at least a first guide member that guides to regulate a front position of the ejected medium and a second guide member that guides to regulate a back position of the ejected medium, wherein at least the first guide member and the second guide member are configured to be movable between the respective guiding positions and the retracted positions.

With this configuration, even if at least two or more guide members are provided, each of the guide members can be retracted from the guiding position to the retracted position. Accordingly, the loading operation of the roll-type medium into the second roll-type medium loading unit can be easily performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
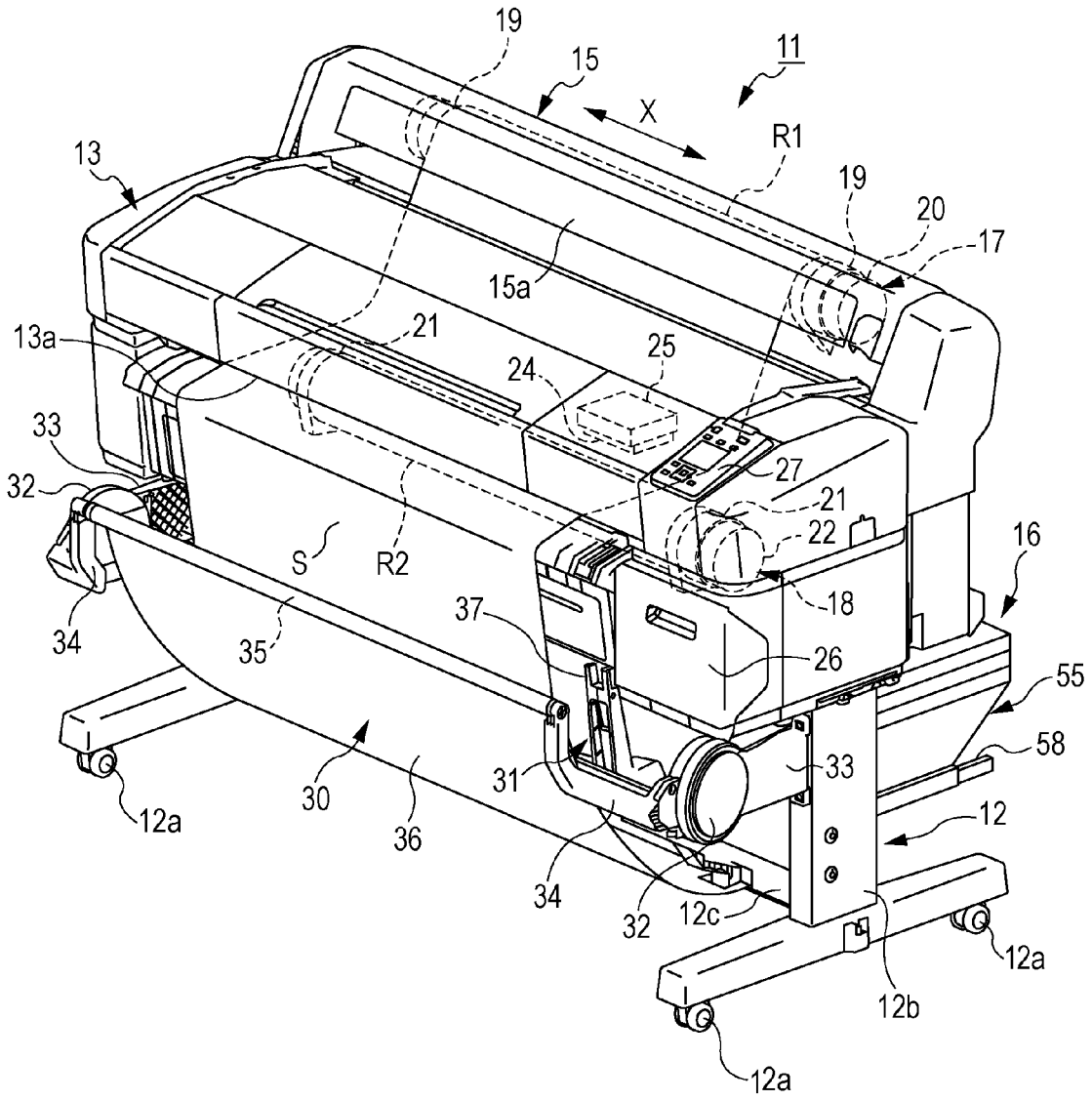
FIG. 1 is a perspective view of a recording apparatus according to an embodiment of the invention.

An embodiment of the invention will be described below with reference to FIGS. 1 to 8. A recording apparatus 11 shown in FIG. 1 is a large printer capable of recording on a sheet S as an example of medium having a relatively large size such as JIS A0 and JIS B0 sizes. The recording apparatus 11 includes legs (stands) 12 having a plurality of caster wheels 12*a* capable of running on a floor surface mounted on the lower end thereof, and an apparatus body 13 having a substantially cuboid shape that is supported on the legs 12. The legs 12 includes a pair of right and left legs 12*b* and a beam member 12*c* that connects the right and left beams 12*b*.

The recording apparatus 11 includes a first feeding unit 15 that is disposed at the upper position on the back side of the apparatus body 13 (the back side in FIG. 1, the right side in FIG. 2), and a second feeding unit 16 that is disposed at the lower position in the apparatus body 13. The first feeding unit 15 includes a first loading unit (first roll holder) 17 in which a roll R1 formed of a sheet S wound into a roll shape can be loaded. The second feeding unit 16 includes a second loading unit (second roll holder) 18 in which a roll R2 can be loaded. In this embodiment, the rolls R1, R2 are provided as an example of a roll-type medium. Further, the first loading unit 17 is provided as an example of a first roll-type medium loading unit, and the second loading unit 18 is provided as an example of a second roll-type medium loading unit.

The first loading unit 17 includes a pair of holders 19 that support the roll R1 on each side in the axial direction. The first feeding unit 15 includes a first feed motor 20 that supplies a rotative power to one of the holders 19 (on the right side in FIG. 1) so that the first feed motor 20 rotates the roll R1, thereby feeding the sheet S from the roll R1. Further, the second loading unit 18 includes a pair of holders 21 that support the roll R2 on each side in the axial direction. The second feeding unit 16 includes a second feed motor 22 that supplies a rotative power to one of the holder 21 (on the right side in FIG. 1) so that the second feed motor 22 rotates the roll R2, thereby feeding the sheet S from the roll R2. Moreover, the first feeding unit 15 includes an openable cover 15*a* that covers the first loading unit 17 and the roll R1 that is loaded in the first loading unit 17.

The sheet S is fed from the roll R1 that is loaded in the first loading unit 17, and then fed into the apparatus body 13 through a first feeding port (not shown in the figure). After recording is performed on the sheet S while being transported along a first transportation path in the apparatus body 13, the sheet S is ejected from an ejection port 13*a* that is provided on the front face of the apparatus body 13. The sheet S is fed from the roll R2 that is loaded in the second loading unit 18, and then fed into the apparatus body 13 through a second feeding port (not shown in the figure). After printing is performed on the sheet S which is being transported along a second transportation path in the apparatus body 13, the sheet S is ejected from an ejection port 13*a* that is provided on the front face of the apparatus body 13.

A carriage 25 having a recording head 24 that opposes the transportation path of the sheet S is disposed in the apparatus body 13 so as to reciprocate in a main scan direction X which is perpendicular to the transportation direction of the sheet S. A cartridge container 26 that houses a plurality of ink cartridges (not shown in the figure) are disposed on the front face of the apparatus body 13 at one end (the right end in FIG. 1) in the longitudinal direction. When the recording head 24 ejects ink which is supplied from the ink cartridges of the cartridge container 26, printing is performed on the sheet S. After printing is performed on the sheet S by the recording head 24, the sheet S which is in the form of a long strip or cut into pieces of a predetermined length is ejected from the ejection port 13*a* on the front face of the apparatus body 13. Further, an operation panel 27 is provided on the top of the apparatus body 13 at one end in the longitudinal direction so that a user inputs the instruction of printing to the recording apparatus 11.

A medium receiving unit 30 (stacker) that receives and stores the sheet S after printing is performed and a guide unit 31 that guides the sheet S which is ejected and falls from the ejection port 13*a* to a position where the sheet S is received in the medium receiving unit 30 are disposed at positions on the lower side of the apparatus body 13.

As shown in FIG. 1, the medium receiving unit 30 has a pair of arm rotation mechanisms 32 each mounted on the front face of the right and left legs 12*b*. Each arm rotation mechanism 32 includes a base 33 that extends forward in the horizontal direction from the leg 12*b* and an arm 34 that is rotatably connected to the base 33. The right arm 34 of a pair of arms 34 in FIG. 1 is bent in a specific shape so as to provide a space through which the user can attach and remove the ink cartridges to and from the cartridge container 26.

A guide shaft 35 is disposed so as to horizontally extend in the width direction of the sheet S between the distal ends of the pair of arms 34. Accordingly, as the arms 34 rotate, the guide shaft 35 is displaced along an arc about the rotation shaft of the arms 34. A basket 36 (medium holding member) made of a fabric or a resin sheet is hung between the guide shaft 35 and an attachment mounted on the beam member 12*c*. In this embodiment, a guide shaft 35 is provided as an example of a guide member.

A plurality of guide members 37 in a substantially plate shape are connected to the beam member 12*c* at the proximal end with a gap between the guide shaft 35 and the guide members 37. The plurality of guide members 37 are spaced from each other in the width direction of the sheet S so that the guide members 37 can guide the sheets S having different widths. Each guide member 37 is pivotally movable about its proximal end and can move between a guiding position shown in FIG. 1 and a retracted position inclined forward. When the guide members 37 are in the guiding position as shown in FIG. 1, even if the leading edge of the sheet S ejected from the ejection port 13*a* is curled, the curled edge abuts against the guide members 37, thereby preventing the sheet S from entering under the apparatus body 13. Accordingly, the sheet S can be guided onto the basket 36.

Figure 2:
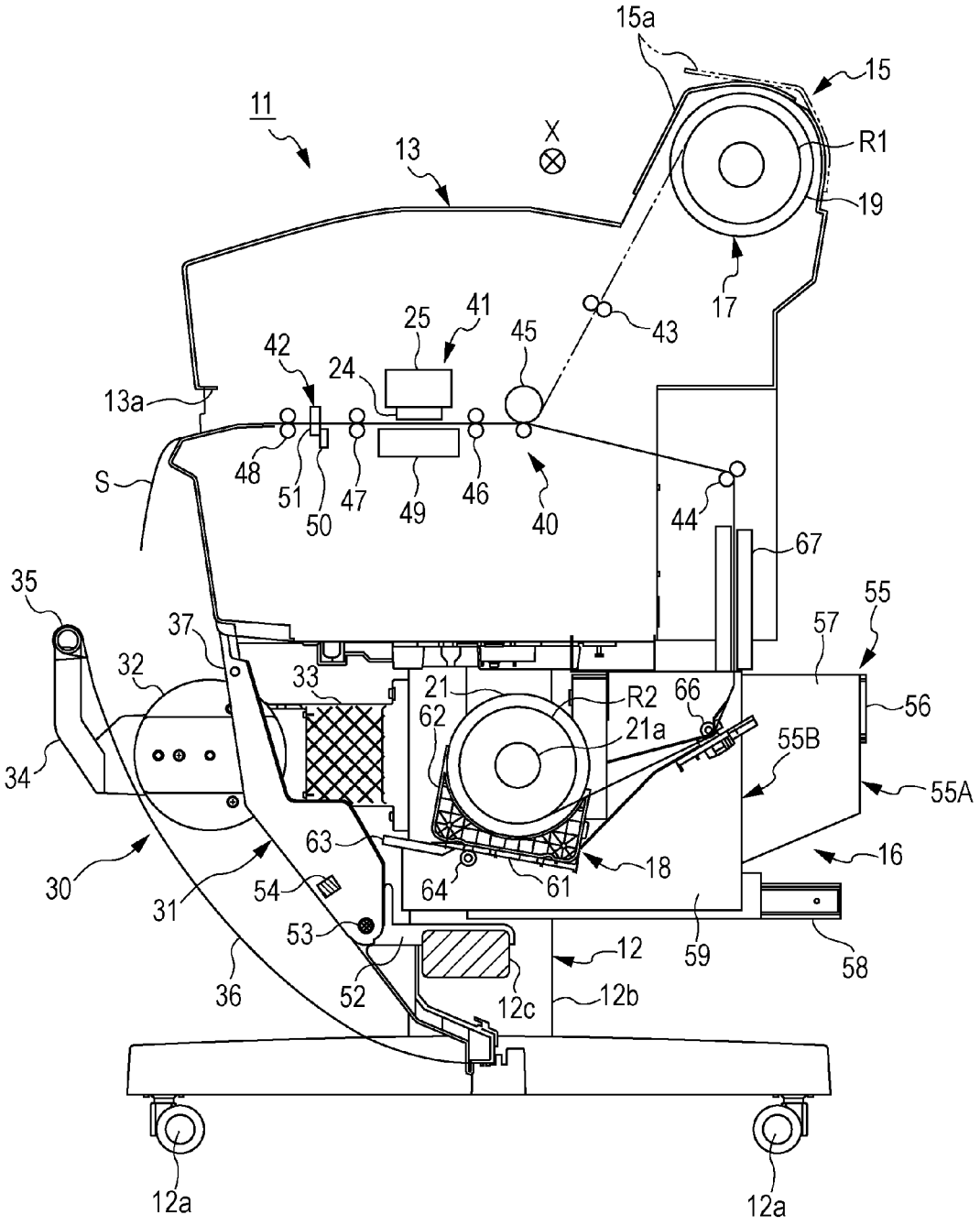
FIG. 2 is a schematic side sectional view of the recording apparatus.

As shown in FIG. 2, the apparatus body 13 includes a transportation unit 40 in which the sheet S fed from the feeding units 15, 16 is transported along a predetermined transportation path, a recording unit 41 in which an image according to the print data is recorded (printed) on the sheet S which is being transported, and a cutter unit 42 in which the printed sheet S is cut at a position downstream to the recording unit 41 in the transportation direction.

The transportation unit 40 includes a pair of rollers 43 that transport the sheet S from the roll R1 in the first feeding unit 15, a pair of rollers 44 that transport the sheet S from the roll R2 in the second feeding unit 16, and pairs of rollers 45, 46, 47, 48 disposed along the transportation path for both the sheets S from the rolls R1, R2 in sequence from upstream of the transportation path. Each of the pairs of rollers 43 to 48 has a drive roller that rotates by a power from a transportation motor, which is not shown in the figure, and a driven roller that rotates by rotation of the drive roller. The pairs of rollers 43 to 48 rotate by a power from the transportation motor, thereby transporting the sheet S.

As shown in FIG. 2, the recording unit 41 includes a support table 49 that supports the sheet S, a recording head 24 that prints on the portion of the sheet S which is on the support table 49, and a carriage 25 that reciprocates in the main scan direction X (the direction perpendicular to the plane of FIG. 2). The support table 49 extends along a transportation path of the recording head 24 (the main scan direction X). The carriage is driven by a power from a carriage motor (not shown in the figure). The recording apparatus 11 performs printing of an image according to print data on the sheet S by substantially alternatively repeating a recording operation for one scan in which ink droplets are ejected from the recording head 24 while the carriage 25 moves in the main scan direction X and a transportation operation in which the sheet S is transported to the next recording position.

As shown in FIG. 2, the cutter unit 42 is disposed at a position between the pairs of rollers 47 and 48 in the transportation direction of the sheet S and includes a rail 50 that extends in a direction parallel to the main scan direction X and a cutter 51 that moves along the rail 50 in the width direction of the sheet S. The sheet S is cut by the cutter 51 into pieces of a predetermined length.

Further, as shown in FIG. 2, the plurality of guide members 37 are supported on the fixation members 52 mounted on the beam member 12*c* with a rotation shaft 53 connected at the proximal end being rotatable. The plurality of guide members 37 are fixedly provided via a single connection rod 54 so that the guide members 37 are integrally rotatable.

The cover 15*a* of the first feeding unit 15 is pivotally movable between an open position for loading and removing of the roll R1 which is indicated by the dashed two dotted line in FIG. 2 and a closed position for covering the roll R1 which is indicated by the solid line in FIG. 2. When the cover 15*a* is at the open position, the user can load and remove the roll R1 to and from the first loading unit 17 from the front of (the front side of) the apparatus body 13.

In this embodiment, the user can also load and remove the roll R2 to and from the second loading unit 18 which is disposed at the lower position in the apparatus body 13 from the front of (the front side of) the recording apparatus 11. As shown in FIG. 2, a position of the second loading unit 18 during printing corresponds to a position immediately below the substantially center of the apparatus body 13 in the front-back direction. Since the position is set back from the front face of the recording apparatus 11 with a significant distance, it is not easy to load and remove the roll R2 to and from the second loading unit 18. Further, since the medium receiving unit 30 and the guide unit 31 are disposed on the lower front positions of the apparatus body 13, both the medium receiving unit 30 and the guide unit 31 interfere with loading and removing operations of the roll R2 to and from the second loading unit 18. That is, the guide shaft 35 and the guide members 37 interfere with the loading and removing operations of the roll R2 to and from the second loading unit 18.

Figure 3:
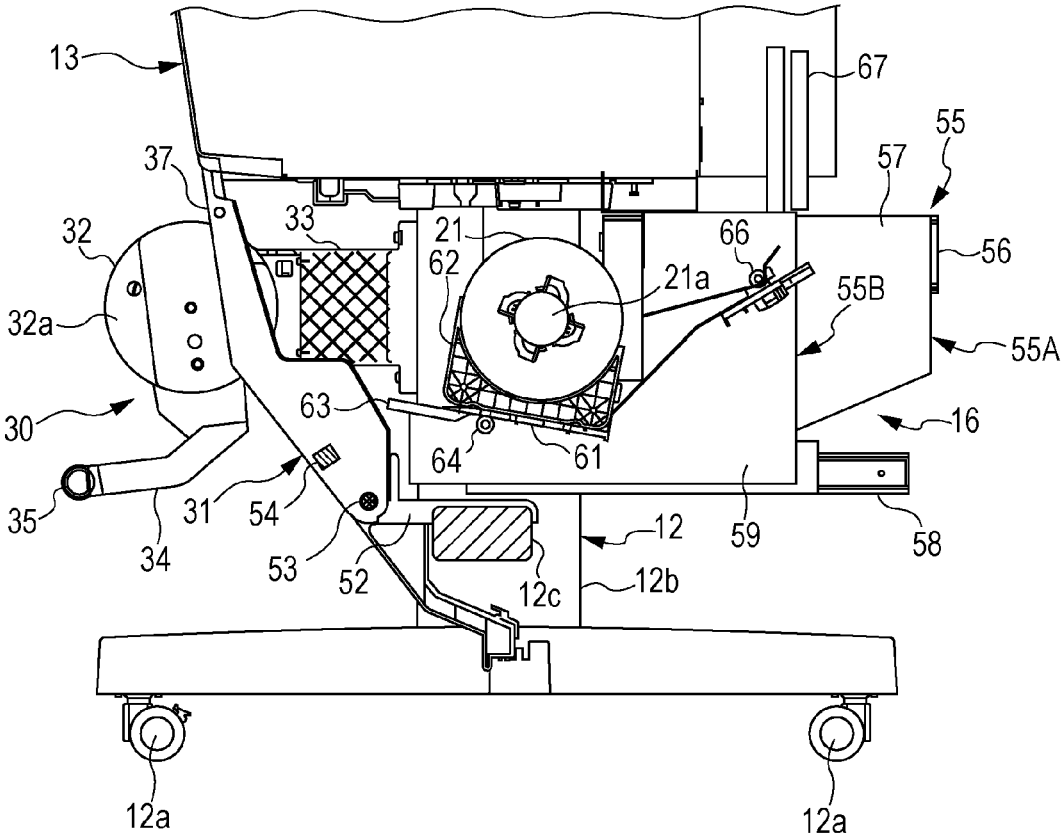
FIG. 3 is a partial side sectional view of the recording apparatus which shows a loading operation process.

In this embodiment, the guide shaft 35 is movable between a waiting position where the leading edge of the ejected sheet S shown in FIG. 2 is regulated by the arm rotation mechanism 32 so that the sheet S is guided into the basket 36, and a retracted position shown in FIG. 3 where the guide shaft 35 is retracted so as not to interfere with the loading and removing operations of the roll R2 to and from the second loading unit 18. Further, the guide members 37 are pivotally movable between the waiting position where the leading edge of the ejected sheet S is regulated so as not to enter under the apparatus body 13 and guided into the basket 36 even if the leading edge of the sheet S is curled, and the retracted position shown in FIG. 4 where the guide members 37 are inclined forward so as not to interfere with the loading and removing operations of the roll R2 to and from the second loading unit 18.

Figure 4:
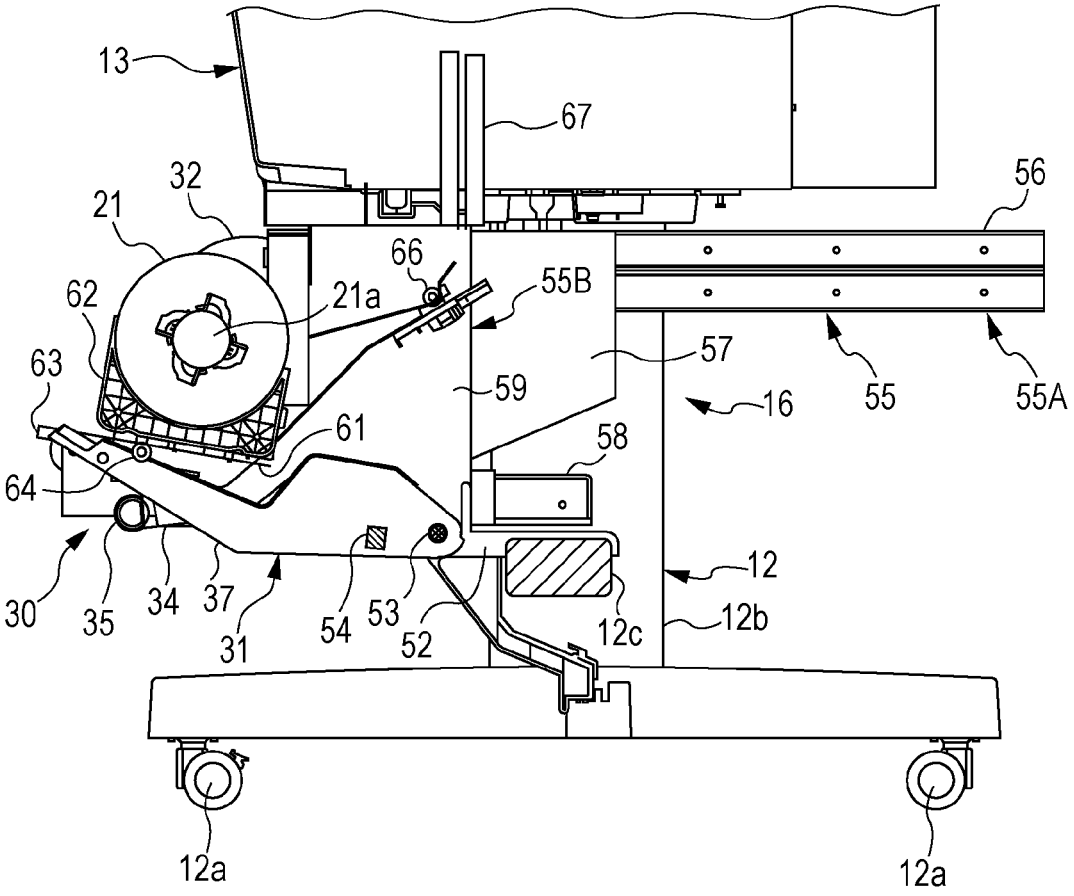
FIG. 4 is a partial side sectional view of the recording apparatus which shows a loading operation process.

The second loading unit 18 is movable in the front-back direction (the right-left direction in FIG. 2) between a waiting position shown in FIG. 2 where recording can be performed by the recording unit 41 and a loading position shown in FIG. 4 which is a position forward of the waiting position and where the roll R2 is loaded. Further, as shown in FIG. 2, the second feeding unit 16 includes a moving mechanism 55 that allows the second loading unit 18 to be movable in the front-back direction.

As shown in FIG. 2, the moving mechanism 55 has a slide configuration of multiple steps type and includes a first moving mechanism 55A and a second moving mechanism 55B that moves relatively to the first moving mechanism 55A in the front-back direction. The first moving mechanism 55A includes a pair of right and left first rails 56 that are mounted on the pair of right and left legs 12*b* and extend in the front-back direction, and a pair of right and left first sliders 57 in a plate shape that are slidably mounted on the first rails 56 in the front-back direction. The second moving mechanism 55B includes a pair of right and left second rails 58 that are mounted on the pair of right and left first slider 57 and extend in the front-back direction, and a pair of right and left second sliders 59 in a plate shape that are slidably mounted on the second rails 58 in the front-back direction.

Figure 5:
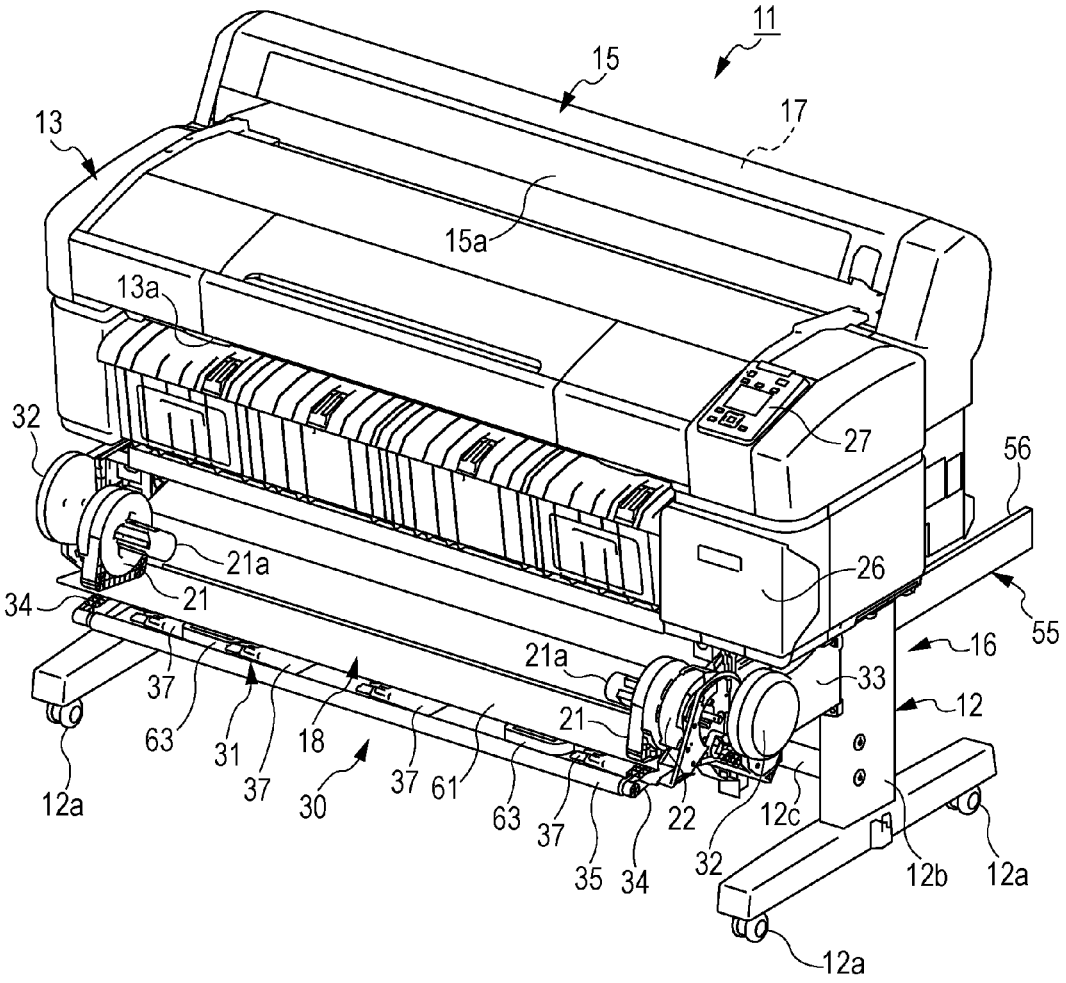
FIG. 5 is a perspective view of the recording apparatus in which a second loading unit is drawn.
Figure 6:
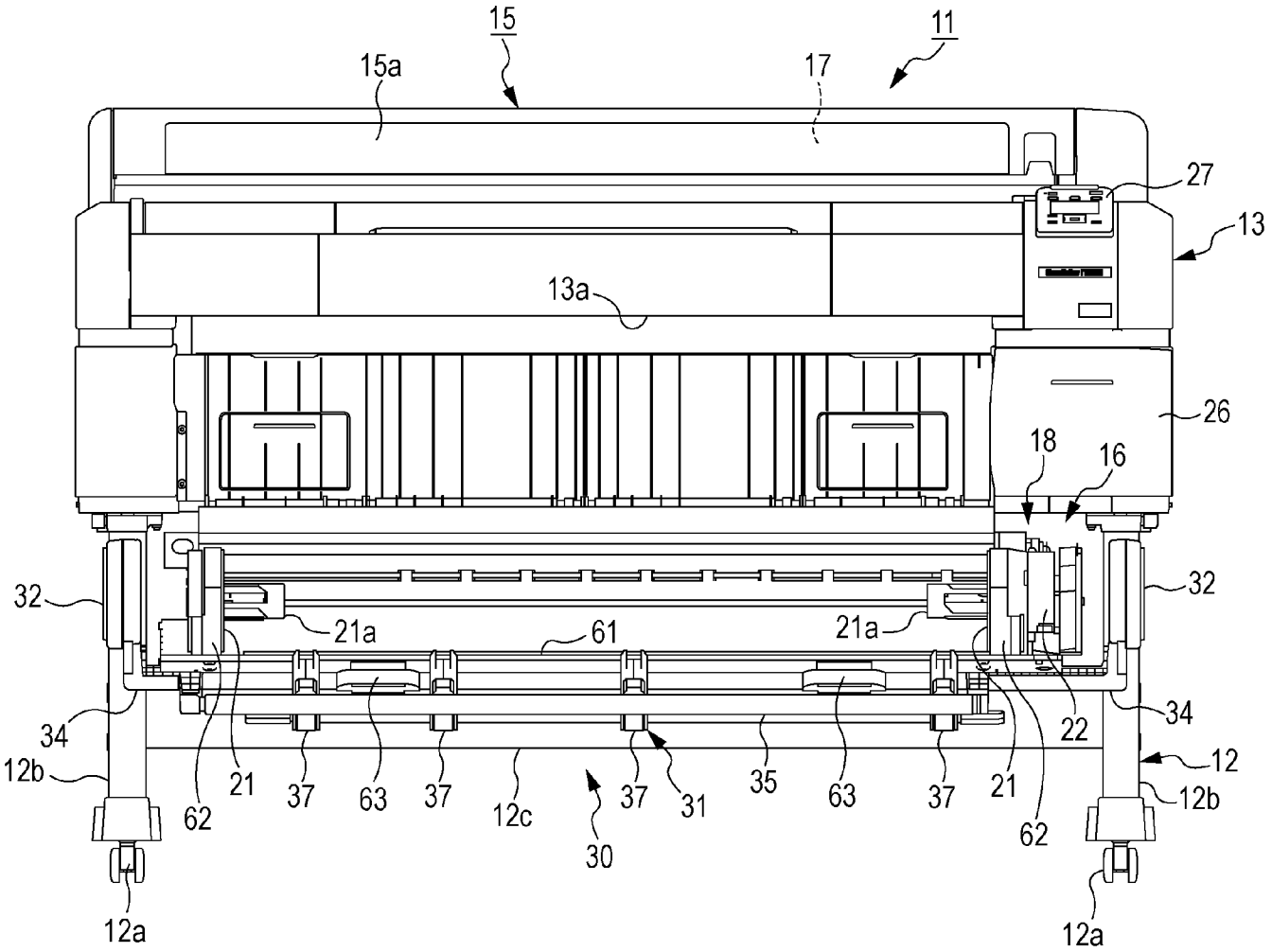
FIG. 6 is a front view of the recording apparatus in which the second loading unit is drawn.

FIGS. 5 and 6 show a state in which the guide shaft 35 and the guide members 37 are positioned at their retracted positions, and the second loading unit 18 is drawn forward of the recording apparatus 11. As shown in FIGS. 2, 5 and 6, the second loading unit 18 includes a square shaped bottom plate 61 and a pair of support members 62 that are supported on the bottom plate 61 and each supports the holder 21. Both ends of the bottom plate 61 in the width direction are secured to the inner surface of the right and left second sliders 59. A driven support member 62 of the pair of support members 62 which is positioned on the side opposite to the second feed motor 22 in FIG. 5 (the left side in FIG. 5, FIG. 6) is movable in the axial direction of the second loading unit 18, and a distance between the pair of holders 21 depending on the length of the roll R2 (the sheet width).

As shown in FIGS. 2, 5 and 6, grip members 63 are formed on the front side of the bottom plate 61 so that the second loading unit 18 is slid by the user in the front-back direction by using the. As shown in FIGS. 5 and 6, the grip members 63 are disposed at positions that correspond to a gap between the guide members 37 in the width direction (the main scan direction) of the recording apparatus 11.

As shown in FIG. 2, an abutment shaft 64 is disposed on the underside of the bottom plate 61 so as to extend in the width direction. During a process in which the second loading unit 18 moves from the waiting position to the loading position, the bottom plate 61 and the abutment shaft 64 abut against the back face (the right side in FIG. 2) of at least one of the plurality of guide members 37, thereby pushing down all the guide members 37 forward about the rotation shaft 53. In this embodiment, the bottom plate 61 and the abutment shaft 64 are provided as an example of an abutment section.

As shown in FIG. 2, the second feeding unit 16 includes a guide mechanism 66 that guides the sheet S fed from the roll R2 loaded in the second loading unit 18 in the backward direction, and a guide section 67 that extends upward from the upper end of the second slider 59 so as to guide the sheet S which has passed the guide mechanism 66 in the upward direction. The sheet S which has been guided from the roll R2 to the guide mechanism 66 and the guide section 67 is further guided to the pair of rollers 44 that are disposed in the apparatus body 13. In this embodiment, the guide mechanism 66 is mounted on the support member 62 or the second slider 59, and the pair of rollers 44 are mounted on the second slider 59 via a bracket which is not shown in the figure. Accordingly, the guide mechanism 66, the guide section 67 and the pair of rollers 44 moves together in the front-back direction as the second loading unit 18 moves between the waiting position and the retracted position. In this embodiment, each of the guide mechanism 66, the guide section 67 and the pair of rollers 44 are provided as an example of a medium guide section.

Figure 7:
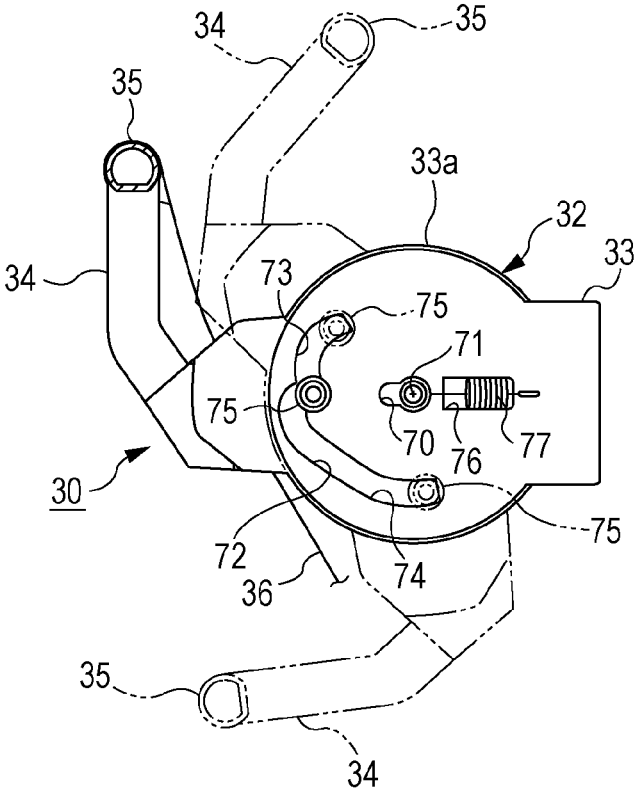
FIG. 7 is a side view of an arm rotation mechanism.

Next, a configuration of the arm rotation mechanism 32 in the medium receiving unit 30 and a configuration of the guide member 37 in the guide unit 31 will be described. First, the configuration of the arm rotation mechanism 32 will be described with reference to FIG. 7. In FIG. 7, part of an exterior of the base 33 of the arm rotation mechanism 32 is not shown.

As shown in FIG. 7, an elongated hole 70 that extends in the front-back direction is formed at a substantially center of the distal end 33*a* of the base 33 which is formed in a substantially disc shape so as to penetrate the distal end 33*a*. A rotation shaft 71 of the arm 34 is inserted through the elongated hole 70 such that the arm 34 is movable relative to the base 33 in the front-back direction. Further, a guide hole 72 having a specified path and a specified length is formed at a position in the front peripheral area of the distal end 33*a* along the periphery so as to penetrate the distal end 33*a*. The guide hole 72 includes a first guide hole section 73 formed in a substantially arc about the elongated hole 70 as the center of arc which extends upward from the lower end at the substantially same height as the elongated hole 70 and a second guide hole section 74 formed in a substantially arc about the elongated hole 70 as the center of arc which extends downward from the lower end of the first guide hole section 73.

An engagement shaft 75 that is secured on the arm 34 at a position radially outward from the rotation shaft 71 by a specified distance is positioned so as to engage in the guide hole 72. The rotation shaft 71 is biased backward by a tension spring 77 which is housed in a recess 76 formed on the distal end 33*a* at a position back of the elongated hole 70. The engagement shaft 75 is brought into press contact with a radially inward inner surface of the guide hole 72. Accordingly, the arm 34 is movable among a receiving position indicated by the solid line in FIG. 7, a housed position indicated by the dashed two dotted line above the receiving position and a retracted position indicated by the dashed two dotted line below the receiving position. The receiving position is a position where the arm 34 is positioned when the sheet S is received by the basket 36. The retracted position is a position where the arm 34 is retracted from the transportation path of the second loading unit 18 so as not to interfere with drawing forward of the second loading unit 18. The housed position is a position where the guide shaft 35 is housed by rotating the arm 34 toward the apparatus body 13 when the basket 36 is not in use.

Figure 8:
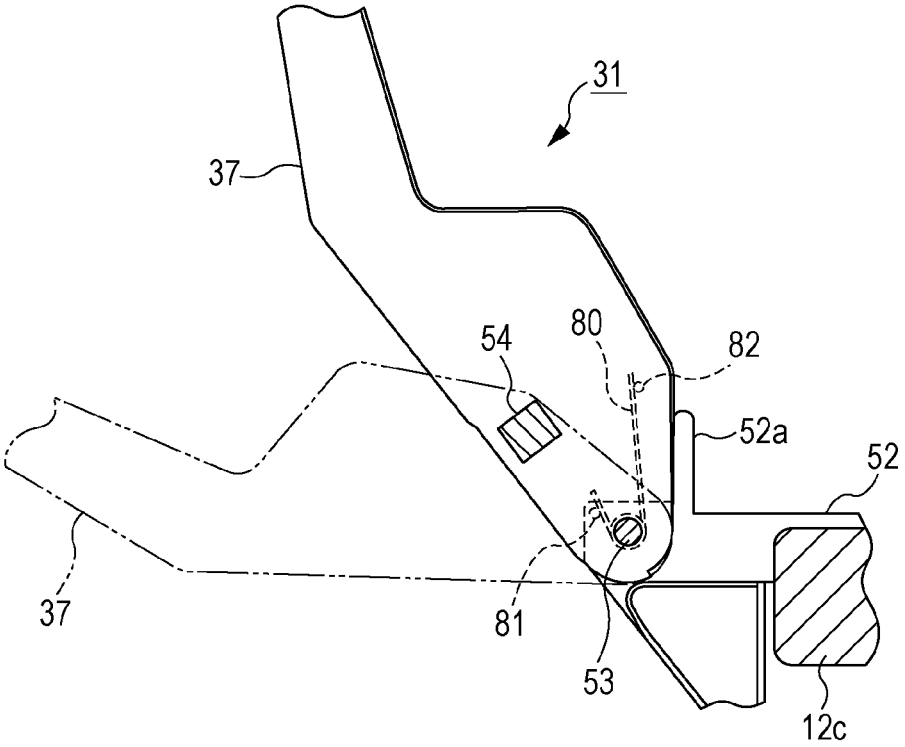
FIG. 8 is a side sectional view of a guide unit.

Next, a configuration of the guide member 37 will be described with reference to FIG. 8. As shown in FIG. 8, a plurality of fixation members 52 are provided on the beam member 12*c* at positions with spaces therebetween corresponding to spaces between the respective guide members 37 in the width direction so as to extend forward (the left side in FIG. 8). The rotation shaft 53 at the proximal end of the guide member 37 is pivotally supported on the distal end of the fixation member 52. A torsion coil spring 80 is mounted on the guide member 37 about the rotation shaft 53 with one end abutting against a projection 81 on the side of the fixation member 52 and the other end abutting a projection 82 on the side of the guide member 37. Accordingly, the guide member 37 is pivotally movable between a waiting position which is a raised position indicated by the solid line in FIG. 8 and a retracted position which is an inclined position indicated by the dashed two dotted line in FIG. 8. The guide member 37 is held in the waiting position by abutting against a stopper member 52*a* that extend upward from the fixation member 52.

Next, an operation of the recording apparatus 11 having the above described configuration will be described below. When a printing operation starts in the recording apparatus 11, the sheet S is fed from the roll R1 in the feeding unit 16 into the apparatus body 13. Then, printing of an image according to print data is performed on the sheet S by substantially alternatively repeating a recording operation in which ink droplets are ejected from the recording head 24 while the carriage 25 moves in the main scan direction X in the apparatus body 13 and a transportation operation in which the sheet S is transported in the transportation direction to the next recording position. The printed sheet S is ejected from the ejection port 13*a*.

The front position of the ejected sheet S is regulated by the guide shaft 35 so that the sheet S does not move further forward and the sheet S is guided to fall on the back side of the guide shaft 35, while the back position of the ejected sheet S is regulated by the guide members 37 and the sheet S is guided to fall on the front side of the guide members 37. Consequently, for example, even if the leading edge of the sheet S is curled upward, the curled edge abuts against the guide shaft 35, which causes the sheet S to fall at a position short of (on the back side of) the guide shaft 35. Further, even if the leading edge of the sheet S is curled downward, the curled edge abuts against the guide members 37, which causes the sheet S to fall on the front side of the guide members 37, preventing the sheet S from entering under the apparatus body 13. Accordingly, the ejected sheet S is received in the basket 36 at an appropriate position and an appropriate orientation.

When the roll R1 in the first feeding unit 15 runs out and is replaced with a new roll R1 during printing, the user opens the cover 15*a* from the front of the recording apparatus 11 and loads a new roll R1 into the first loading unit 17. Accordingly, the user can relatively easily perform a loading operation of the roll R1.

Further, when the roll R2 in the second feeding unit 16 runs out and is replaced with a new roll R2, the user can also perform the loading operation of the roll R2 into the second loading unit 18 from the front of the recording apparatus 11. The loading operation of the roll R2 into the second loading unit 18 will be described below with reference to FIGS. 2 to 6.

First, the user manually moves the guide shaft 35 from a guiding position (receiving position) shown in FIG. 2 to the retracted position shown in FIG. 3. Consequently, the guide shaft 35 and the arm 34 are positioned at positions lower than the height of the second loading unit 18 (lower position). At this time, even if the basket 36 is hung on the guide shaft 35, the basket 36 is also positioned at a position lower than the height of the second loading unit 18. That is, the medium receiving unit 30 can be retracted to a position that does not interfere with the second loading unit 18 on the transportation path of the second loading unit 18.

Then the user puts his/her hand through the gap between the guide members 37, grips the grip member 63 and pulls the grip member 63 in the front direction (forward). Consequently, as the first slider 57 moves forward along the first rail 56, the second loading unit 18 moves from the waiting position shown in FIG. 3 to the loading position shown in FIG. 4. During this movement, the front end of the bottom plate 61 (abutment section) of the second loading unit 18 abuts against the guide members 37. With this abutment, the guide members 37 pivotally move from the guiding position shown in FIG. 3 in the counterclockwise direction in FIG. 3. When the guide members 37 have rotated by a predetermined angle, the abutment shaft 64 abuts against the back side of the guide members 37. The guide members 37 are pushed down by the abutment shaft 64 and moves to the retracted position shown in FIG. 4. That is, since the front end of the bottom plate 61 and the abutment shaft 64 of the second loading unit 18 sequentially abut against the guide members 37 and push down the guide members 37 forward, the guide members 37 are inclined forward as the second loading unit 18 moves forward. When the second loading unit 18 is positioned at the loading position, the guide members 37 are positioned below the loading unit 18 as shown in FIG. 4. Accordingly, both the guide shaft 35 and the guide members 37 are positioned below the second loading unit 18 and do not interfere with the loading operation of the roll R2 into the second loading unit 18.

In this embodiment, as the second slider 59 moves forward relative to the first slider 57, the second loading unit 18 which has been positioned at the loading position can cause the loading position to be further moved forward within a range of a predetermined distance. Accordingly, by drawing the second loading unit 18 further forward, a larger working space can be provided for the loading operation of the roll R2. After the roll R2 is loaded into the second loading unit 18, the sheet S pulled out backward from the roll R2 is set on the guide mechanism 66, the guide section 67 and the pair of rollers 44 which have been moved forward with the second loading unit 18. Further, the second slider 59 is locked to the first slider 57, and the lock is released, for example, by slightly pushing the grip member 63 either upward or downward. This allows the second loading unit 18 to be moved in the front-back direction within a range of a predetermined distance.

After the roll R2 is loaded and the sheet S is set on the guide mechanism 66 and the like, the user grips the grip member 63 and pushes the second loading unit 18 backward. This causes the second loading unit 18 to move from the loading position shown in FIG. 4 to the waiting position shown in FIG. 3. During this movement, when the second loading unit 18 moves backward, the guide members 37 rotates in the clockwise direction in FIG. 4 while abutting against the front end of the bottom plate 61 due to a biasing force of the torsion coil spring 80. As a consequence, with the movement of the second loading unit 18 from the loading position to the waiting position, the guide members 37 move from the retracted position shown in FIG. 4 to the guiding position shown in FIG. 3. Accordingly, the user does not need to perform an additional operation to move the guide members 37 from the retracted position to the guiding position.

Then, the user manually moves the guide shaft 35 from the retracted position shown in FIG. 3 to the guiding position (receiving position) shown in FIG. 2. Since the replacement operation of the roll R2 is performed at a lower position which is opposite of the first feeding unit 15 with respect to the recording unit 41, the sheet S fed from the roll R1 to the recording unit 41 does not interfere with the replacement operation (loading operation). Accordingly, even when the sheet S is fed from the roll R1 during printing, the replacement operation of the roll R2 can be performed. Further, since the replacement operation of the roll R1 is performed at an upper position which is opposite of the second feeding unit 16 with respect to the recording unit 41, the sheet S fed from the roll R2 to the recording unit 41 does not interfere with the replacement operation (loading operation). Accordingly, even when the sheet S is fed from the roll R2 during printing, the replacement operation of the roll R1 can be performed.

As described above in detail, the following effect can be achieved according to the above embodiment:

(1) The first loading unit 17 and the second loading unit 18 are provided at the upper and lower positions with respect to the recording unit 41, respectively, and are configured such that the rolls R1 and R2 can be loaded, respectively, from the front of the recording apparatus 11. Accordingly, the loading units 17, 18 can be easily accessed in the loading operation of the roll. For example, in a configuration that two loading units are stacked and both are disposed at an upper position or a lower position with respect to the recording unit 41, the sheet fed from one of the rolls passes through the path at the front of the other of the rolls. As a consequence, the replacement operation of the other of the roll cannot be performed during printing of the sheet fed from one of the rolls. In the recording apparatus 11 of this embodiment, since the loading units 17, 18 are separately provided at the upper and lower positions with respect to the recording unit 41, respectively, the sheet S fed from one of the rolls R1, R2 to the recording unit 41 do not interfere with the replacement operation of the other of the rolls. Accordingly, the replacement operation of the roll R2 can be performed during printing of the sheet S of the other roll.

(2) A guide members 37 are provided at the front of the second loading unit 18 which is positioned at the waiting position where recording can be performed by the recording unit 41 so that the guide member guides the recorded sheet S when the sheet S is ejected. The guide members 37 are configured to be movable between the guiding position where the sheet S is guided and the retracted position where the guide members 37 are positioned so as not to interfere with the loading operation of into the second loading unit 18. Accordingly, during the loading operation into the second loading unit 18, the guide members 37 disposed at the front of the second loading unit 18 are moved from the guiding position to the retracted position, thereby preventing the guide members 37 from interfering with the loading operation and enabling the second loading unit 18 to be accessed with ease in the loading operation. In particular, since the guide members 37 are retracted below the second loading unit 18, a larger space is provided above the second loading unit 18 compared with the case where the guide member is retracted upward. Accordingly, the loading operation of the roll R2 into the second loading unit 18 is performed with ease.

(3) The guide shaft 35 is provided at the front of the second loading unit 18 which is positioned at the waiting position so that the guide member 35 guides the recorded sheet S when the sheet S is ejected. The guide shaft 35 is configured to be movable between the guiding position where the sheet S is guided and the retracted position where the guide shaft 35 is positioned so as not to interfere with the loading operation of into the second loading unit 18. Accordingly, during the loading operation into the second loading unit 18, the guide shaft 35 that is disposed at the front of the second loading unit 18 is moved from the guiding position to the retracted position, thereby preventing the guide shaft 35 from interfering with the loading operation and enabling the second loading unit 18 to be accessed with ease in the loading operation. In particular, since the guide shaft 35 is retracted below the second loading unit 18, a larger space is provided above the second loading unit 18 compared with the case where the support shaft is retracted upward. Accordingly, the loading operation of the roll R2 into the second loading unit 18 is performed with ease.

(4) Both the guide shaft 35 that guides the ejected sheet S so as not to move forward out of the basket 36 and the guide member 37 that guides the ejected sheet S so as not to enter under the apparatus body 13 are configured to be movable between the guiding position and the retracted position. Accordingly, since both the guide shaft 35 and the guide member 37 are positioned at the retracted position, the guide shaft 35 and the guide member 37 do not interfere with the loading operation of the roll R2 into the second loading unit 18, thereby increasing efficiency of the loading operation.

(5) The second loading unit 18 is configured to be movable by the moving mechanism 55 between the waiting position where recording can be performed by the recording unit 41 and the loading position which is a position forward of the waiting position during loading of the roll R2. Since the second loading unit 18 can be drawn forward from the waiting position to the loading position, the second loading unit 18 can be accessed with ease. Accordingly, the user does not need to put his/her hand into the lower inside of the apparatus body 13, for example, for the loading operation of the roll R2, and can relatively easily perform the loading operation of the roll R2. Since the second loading unit 18 can be moved backward from the loading position after the loading operation of the roll R2, the second loading unit 18 in which the roll R2 is loaded can be easily positioned at the waiting position.

(6) The second loading unit 18 includes the bottom plate 61 and the abutment shaft 64 that abut against the guide members 37 when the second loading unit 18 moves from the waiting position to the loading position. During a process in which the second loading unit 18 is moved from the waiting position to the loading position, with the abutment of the bottom plate 61 and the abutment shaft 64, the guide members 37 move from the guiding position to the retracted position. When the second loading unit 18 moves from the waiting position to the loading position, the bottom plate abuts against the guide members 37 and the guide members 37 moves from the guiding position to the retracted position. Accordingly, there is no need to perform an additional operation such as moving the guide members 37 from the guiding position to the retracted position in advance. Therefore, the second loading unit 18 can be relatively easily positioned from the waiting position to the loading position.

(7) The torsion coil spring 80 (bias member) that biases the guide members 37 in the direction from the retracted position to the guiding position is provided. When the second loading unit 18 moves from the loading position to the waiting position, the guide members 37 return from the retracted position to the guiding position while abutting against the bottom plate 61 and the abutment shaft 64 due to a biasing force of the torsion coil spring 80. Accordingly, there is no need to perform an additional operation such as returning the guide members 37 from the retracted position to the guiding position after the second loading unit 18 is moved from the loading position to the waiting position.

Therefore, the operation to be performed by the user after the second loading unit 18 is moved from the loading position to the waiting position can be reduced.

(8) The moving mechanism 55 includes the first moving mechanism 55A that moves the second loading unit 18 between the waiting position and the loading position and the second moving mechanism 55B that moves the second loading unit 18 which has been positioned at the loading position by the first moving mechanism 55A further forward, thereby displacing the loading position further forward. Accordingly, when the second loading unit 18 which has been positioned at the loading position by the first moving mechanism 55A is moved further forward by the second moving mechanism, the loading operation of the roll R2 into the second loading unit 18 can be easily performed.

(9) The guide mechanism 66, the guide section 67 and the pair of rollers 44 (medium guide section) that guide the roll R2 loaded in the second loading unit 18 to the recording unit 41 are configured to move with the second loading unit 18. Accordingly, when the second loading unit 18 moves from the waiting position to the loading position, the guide mechanism 66, the guide section 67 and the pair of rollers 44 move with the second loading unit 18. After the roll R2 is loaded into the second loading unit 18, the sheet S pulled out from the roll R2 can be set on the guide mechanism 66, the guide section 67 and the pair of rollers 44 from the front of the recording apparatus 11.

The above embodiment may be modified as follows:

The guide member may be one of the guide shaft 35 and the guide member 37. For example, although the guide member 37 has been described as rotatable, the guide member 37 may be fixedly provided at a position that does not interfere with drawing of the guide shaft 35 that supports the basket 36 forward of the second loading unit 18. Further, for example, a configuration that eliminates the guide member 37 or a configuration that eliminates the guide shaft 35 may be possible. Moreover, the guide member 37 may have its proximal end at the upper end and may be configured to be rotatable about the upper end.

The retracted position of the guide member is not limited to the retracted position provided below the second loading unit, and may be a retracted position provided above the second loading unit, a retracted position provided on the right side of the second loading unit and a retracted position provided on the left side of the second loading unit. Further, in the case where a unit of a plurality of guide members is provided, a plurality of guide members may be retracted to retracted positions in two or more different directions. That is, any configuration is possible as long as the guide member can be retracted so as to allow the second loading unit to be positioned at the loading position.

The moving mechanism 55 may not be provided. For example, a configuration is possible in which the second loading unit is fixedly provided at the waiting position and the user moves the roll backward and loads the roll into the second loading unit. Since the user can manually push down the guide member to the retracted position, the loading operation can be performed without significant interference with the guide member. In this configuration, it is preferable to provide a stop mechanism that holds the guide member at the retracted position. Moreover, a configuration is also possible in which the waiting position of the second loading unit is provided at a position closer to the front than the waiting position shown in FIG. 2 such as a position immediately back of the guide member, and the moving mechanism is not provided. In this configuration, since a distance of the roll R2 to be moved backward by the user is reduced, the loading operation can be relatively easily performed.

Two types of guide members, the guide shaft 35 of the medium receiving unit 30 and the guide member 37 of the guide unit 31, may not be provided, and one of the guide shaft 35 and the guide member 37 may be provided. For example, a configuration having the guide unit 31 without having the medium receiving unit 30 may be used. Alternatively, a configuration having the medium receiving unit 30 without having the guide unit 31 may be used. One or more guide members may be provided in addition to the two types of guide members. Further, the guide member other than the guide shaft 35 and the guide member 37 may be used. Even with such configurations, the second loading unit 18 can be easily accessed by providing the guide member to be movable between the guiding position and the retracted position.

The abutment section may be one of the bottom plate 61 and the abutment shaft 64. Alternatively, a roller that rotates while abutting against all or some of the guide members 37 may be used instead of the abutment shaft 64.

Although the moving mechanism 55 has been described as a manual type that the user manually moves the second loading unit 18, a configuration that the second loading unit 18 is moved by using a power supply such as an electric motor is also possible.

The moving mechanism 55 may not be of a double-stage sliding configuration, and may be of a single-stage sliding configuration or a multiple-stage sliding configuration such as three or more stage sliding configuration.

The medium guide section that is movable with the second loading unit 18 is not limited to the guide mechanism 66, the guide section 67 and the pair of rollers 44. For example, only the guide mechanism may be movable, or only the guide mechanism 66 and the guide section 67 may be movable. Alternatively, the medium guide section other than the guide mechanism 66, the guide section 67 and the pair of rollers 44 may be provided.

The recording apparatus is not limited to an ink jet type, and may be of a dot impact type or a laser type. Further, the recording apparatus is not limited to a serial printer, and may be a line printer or a page printer.

The recording apparatus is not limited to a recording apparatus that forms an image on the sheet by printing (recording), and may be a multi-purpose machine having printing function, scanner function and copy function.

The medium is not limited to the sheet S such as a paper sheet, and may be a resin film, a metal foil, a metal film, a composite film of resin and metal (laminate film), a fabric, a non-woven fabric, or a ceramic sheet.

In a configuration that the basket 36 is not hung over the guide shaft 35, or in a configuration that a winding device instead of the basket 36 is mounted on the legs 12 so as to wind the sheet S into a roll-shape, the housed position above the guide shaft 35 may be defined as the retracted position for retraction during loading operation into the second loading unit 18.

The guide shaft 35 may be configured not to be manually moved to the retracted position, and may be configured to be moved to the retracted position by abutment of the abutment section against the guide shaft 35 when the second loading unit 18 is drawn forward.

The term "front of the recording apparatus" as used herein refers to a front side of the recording apparatus. For example, a position where the user stands facing the recording apparatus when confirming recording state (such as quality of recording) of the medium is on the front side. In many recording apparatuses, the side where an ejection port is provided is the front side. Alternatively, for example in the recording apparatus having an operation panel, a position where an operator stands when operating the operation panel is on the front side.

The entire disclosure of Japanese Patent Application No. 2012-114156, filed May 18, 2012, is expressly incorporated by reference herein.

What is claimed is:

1. A recording apparatus comprising:

a plurality of roll-type medium loading unit that are positioned so that a roll-type medium can be loaded therein from a front of the recording apparatus;

a transportation unit that transports the medium which has been fed from the roll-type medium loading unit in the downstream direction;

a recording unit that performs recording on the transported medium, wherein the roll-type medium loading unit includes a first roll-type medium loading unit that is disposed at a position above the recording unit and a second roll-type medium loading unit that is disposed at a position below the recording unit, and a guide member that is disposed in front of the second roll-type member loading unit, the guide member being part of a medium receiving unit that receives a recorded medium after the recording unit has performed the recording on the medium, the guide member guiding the recorded medium to a holding unit of the medium receiving unit.

2. The recording apparatus according to claim 1, wherein the guide member is disposed in front of the second roll-type medium loading unit when the second roll-type medium is positioned at a waiting position where recording can be performed by the recording unit, wherein the guide member guides the recorded medium when the medium is ejected, wherein the guide member is configured to be movable between a guiding position where the guide member guides the medium and a retracted position where the guide member is positioned so as not to interfere with the second roll-type medium loading unit during loading of the roll-type medium into the second roll-type medium loading unit.

3. The recording apparatus according to claim 2, further comprising a first moving mechanism that moves the second roll-type medium loading unit between the waiting position and the loading position, and a second moving mechanism that displaces the loading position of the second roll-type medium loading unit that has been positioned by the first moving mechanism further forward.

4. The recording apparatus according to claim 2, wherein the guide member includes at least a first guide member that guides to regulate a front position of the ejected medium and a second guide member that guides to regulate a back position of the ejected medium, wherein at least the first guide member and the second guide member are configured to be movable between the respective guiding positions and the retracted positions.

5. The recording apparatus according to claim 1, wherein the second roll-type medium loading unit is configured to be movable between a waiting position and a loading position which is a position forward of the waiting position during loading of the roll-type medium.

6. The recording apparatus according to claim 5, wherein the second roll-type medium loading unit includes an abutment section that abuts against guide member when the second roll-type medium loading unit moves from the waiting position to the loading position, and the guide member moves from the guiding position to the retracted position with the abutment of the abutment section.

7. The recording apparatus according to claim 5, further comprising at least one medium guide section that guide the roll-type medium loaded in the second roll-type medium loading unit to the recording unit, wherein at least one of the medium guide sections is configured to move with the second roll-type medium loading unit.

* * * * *